US005692411A

United States Patent [19]

Tamura

[11] Patent Number: 5,692,411

[45] Date of Patent: Dec. 2, 1997

[54] QUIET PAPER SORTER USING A COLLISION IMPACT REDUCTION MEANS

[75] Inventor: Masahiro Tamura, Yokohamashi, Japan

[73] Assignee: Ricoh Co., Ltd., Tokyo, Japan

[21] Appl. No.: 468,874

[22] Filed: Jun. 6, 1995

[30] Foreign Application Priority Data

Nov. 17, 1984 [JP] Japan ..... 6-283506
Jun. 8, 1994 [JP] Japan ..... 6-126370

[51] Int. Cl.[6] ..... B65H 31/24; G03G 15/00

[52] U.S. Cl. ..... 74/436; 74/84 R; 271/292; 271/294

[58] Field of Search ..... 74/436, 84 R, 74/820; 271/292, 293, 294; 270/58.19

[56] References Cited

U.S. PATENT DOCUMENTS

| | | | |
|---|---|---|---|
| 4,328,963 | 5/1982 | DuBois et al. | 271/293 |
| 4,647,034 | 3/1987 | Sawa | 271/293 |
| 4,878,660 | 11/1989 | Irie | 271/293 |
| 5,112,035 | 5/1992 | Yamamoto et al. | 271/293 |
| 5,180,152 | 1/1993 | Irie | 271/292 X |

FOREIGN PATENT DOCUMENTS

| | | |
|---|---|---|
| 64-34865 | 2/1989 | Japan . |
| 5-30051 | 7/1993 | Japan . |

*Primary Examiner*—Rodney H. Bonck
*Assistant Examiner*—Troy Grabow
*Attorney, Agent, or Firm*—Woodcock Washburn Kurtz Mackiewicz & Norris LLP

[57] ABSTRACT

The current invention discloses methods and apparatus for quieter sorters. The quieter sorter reduces the collision noises generated by movable pins of the sorter trays and a Geneva wheel which controls the movement of the sorter trays. The movable pins generally receive a force, and the force is necessary to advance the trays in a predetermined direction. As a particular pin approaches the Geneva wheel, a collision protector isolates this approaching movable pin from the force. When the Geneva wheel engages the isolated movable pin, since the isolated pin is free from the force, the isolated pin does not collide onto the Geneva wheel. This smooth engagement of the Geneva wheel substantially reduces the noise level associated with the travel of the movable pins.

24 Claims, 12 Drawing Sheets

30
40
48
5
4b
4c
5b
6
8
50
52
54
56
φ
δ
τ

QUIET PAPER SORTER USING A COLLISION IMPACT REDUCTION MEANS

FIELD OF THE INVENTION

The current invention is generally related to methods and apparatus for making the paper sorter using a Geneva wheel or a similar cam mechanism quieter and in particular to methods and apparatus for substantially reducing a collision between a movable member and the Geneva wheel thereby reducing an undesirable noise level of the paper sorter in an image-duplication machine such as a photocopier, a printer and the alike.

BACKGROUND OF THE INVENTION

Image duplicating machines such as a photocopier, a fax machine, a printer and the like reproduce images on image-carrying media such as sheets of paper, plastic films and the like. These reproduced outputs are often made in multiple duplicates and need to be sorted for distribution. To facilitate such sorting tasks, a modern duplicating machines are equipped with a sophisticated sorting capabilities. For example, to reproduce six copies of five-page document, it is more efficient to make six copies of each page at a time rather to make a copy of each page and repeat six times since the former requires a less number of mechanical actions. These thirty copies or sheets of image-carrying media must be sorted into six piles of documents as each page is duplicated. To sort these documents, prior attempts such as Japanese Utility Model Patent 5-30051 and Japanese Patent 64-34865 disclose a series of movable trays.

Referring to FIG. 1, a sorter assembly 2 is located adjacent to a pair of opposing dispensing rollers 15 of an image reproduction machine 1. The sorter assembly 2 includes at least a predetermined number of trays 3, a vertical path guide 5 and a geneva wheel or a similar cam mechanism 6. The trays 3 are stacked on top of each other, and they independently move in a predetermined vertical path defined by the path guide 5. As the tray 3 moves towards the dispensing rollers 15, each tray 3 must be positioned at a predetermined receiving position with respect to the dispensing rollers 15 so that the image-carrying medium such a sheet of paper is placed on the tray 3. As soon as the tray 3 receives the image-carrying medium, the tray 3 is moved away from the predetermined receiving position towards a top portion of the guide path 5.

Referring to FIG. 2, in order to transfer the trays 3 in the above described manner, one edge of each tray 3 is connected to a pin 4 and the Geneva wheel 6 controls the movement of the pin 4. Generally, the pin 4 is made of a metal and longer than the width of the tray 3, and each end of the pin 4 provides a projection. These projected ends of the pins 4 are movably placed on top of each other in the vertical path guide 5 so that the trays 3 are moved in a vertical direction. The Geneva wheel 6 is generally made of plastic and fixedly located near the receiving position, and a motor 13 rotates the geneva wheel 6 via a belt 7 so as to transfer the trays 3 along the vertical path guide 5. One example of the Geneva wheel 6 has an outer surface 9 around its edge and a pair of elongated grooves **8*a* and 8*b*. An opening of each groove 8*a* and 8*b* intersects the outer surface 9. When this Geneva wheel 6 rotates in a clockwise direction as shown by an arrow, a top pin 4*a*, an inner wall of the elongated groove 8*b* engages the top pin 4*a* and then carries the top pin 4*a* in an upward direction along the path guide 5. Although this example shows two grooves 8*a* and 8*b***, any number of grooves may be used. Generally, the number of the grooves and the rotation speed of the Geneva wheel determine an interval between the tray movements.

Still referring to FIG. 2, during the above described upward tray movement, a biasing means such as a biasing spring 12 provides upward bias to the pins 4. Because of this upward force, the pins 4 are pushed along the guide 5 towards the Geneva wheel 6. As the pin 4 reaches the Geneva wheel 6, initially the pin 4 makes a physical contact with the outer surface 9 before entering into the elongated groove 8. Before the pin 4 is completely placed within the groove 8 defined by inner walls of the elongated groove 8, the above described bias force continues to push the pin 4 in the predetermined direction. However, although FIG. 2 does not show, once the pin 4 is in the groove 8, the pin 4 is no longer subject to the bias exerted by the biasing spring 12.

Despite its simplicity and effectiveness as a biasing means, the spring 12 causes the pin 4 to collide onto the Geneva wheel to generate an undesirably loud noise. When the pin 4 initially contacts the outer surface 9 of the rotating Geneva wheel 6, the pin 4 follows the contour of the outer surface 9 without generating a undesirably loud noise. However, when the pin 4 is just about to enter into the elongated groove 8, in general, the pin 4 fails to follow the outer surface 9 of the Geneva wheel 6 due to a sudden change in the contour shape and the upward bias causes the steel pin 4 to collide onto an inner plastic wall of the groove 8. This collision generates an undesirable and harsh noise during the sorting operation.

In order to reduce the collision noise, Japanese Patent 64-34865 discloses that instead of moving the pins by a biasing means, the Geneva wheel itself moves to a next available pin 4 that is to be transferred. This alternative means to position the Geneva wheel requires at least a mechanical means for positioning the Geneva wheel and a controlling means for controlling the mechanical means. Such additional means make a sorter system more complex and more expensive than the spring biased system.

Referring now to FIG. 3, after the pins 4 are all transferred to top portion of the path guide 5 above the Geneva wheel 6, the pins 4 are now transferred back to a bottom portion of the path guide 5 below the Geneva wheel 6. To accomplish the downward transfer, the Geneva wheel 6 is rotated in a counter clockwise direction as shown by an arrow. As described above for the upward transfer, an elongated groove **8*a* of the Geneva wheel 6 engages a bottom pin 4*b* and carries it towards the bottom portion of the path guide 5. Upon engaging the bottom pin 4*b* in the groove 8*a*, due to the gravitational force on the pins 4, the bottom pin 4*b* collides onto an inner wall of the groove 8*a*. In addition, the collided bottom pin 4*b* rebounds and conveys the bouncing movement to the rest of the pins 4**. Both the initial collision and the rebound movements generate undesirable noises and vibrations as the pins are transferred back towards the bottom of the sorter.

As described above, the sorters using a Geneva wheel are generally noisy and the noise level remains to be reduced without complicating the sorter mechanism or raising the manufacturing costs.

SUMMARY OF THE INVENTION

To solve the above identified problems, an apparatus according to one preferred embodiment of the current invention discloses an improved cam for substantially reducing a noise generated by imparting motion to a movable member. The improved cam includes a body having an outer surface located along an edge of the body for guiding the movable member along a contour of the outer surface; a groove located on the body and having an inner wall, the inner wall intersecting the outer surface for engaging the movable member; and a collision protector located near the groove for preventing the movable member from colliding onto the inner wall upon engaging the groove thereby reducing a noise generated by a collision between the inner wall and the movable member.

According to a second aspect of the current invention, an improved Geneva wheel for substantially reducing a noise generated by imparting motion to a movable member. The improved Geneva wheel includes a disk-like body having a center of rotation and an outer surface along an edge of the disk-like body for guiding the movable member along the outer surface as the disk-like body rotates about the center of rotation; a groove located on the disk-like body and having an inner wall, the inner wall intersecting the outer surface for engaging the movable member; and a collision protector located near the groove for preventing the movable member from colliding onto the inner wall upon engaging the groove thereby reducing a noise generated by a collision between the inner wall and the movable member.

According to a third aspect of the current invention, an improved sorter system for substantially reducing a noise, includes a plurality of movable members each having a sorter tray; a guide path for guiding the plurality of the movable members along a predetermined path; a biasing means for exerting a biasing force on the plurality of the movable members in a predetermined direction along the guide path; a Geneva wheel located near the guide path and having at least one groove for engaging one of the plurality of the movable members so as to advance the movable members at a predetermined interval along the guide path, the groove having an inner wall; and a collision protector located near the groove for preventing the movable members from colliding onto the inner wall upon engaging the groove thereby reducing a noise generated by a collision between the inner wall and the movable members.

According to the fourth aspect of the current invention, a method of substantially reducing a noise generated by a movable member upon contacting an inner wall of a groove located on a Geneva wheel, includes the following steps: a) exerting a force on the movable member in a predetermined direction towards the Geneva wheel; b) rotating the Geneva wheel until the groove approaches the movable member; and c) substantially preventing the force from exerting on the movable member so as to reduce a collision impact on the inner wall of the groove by the movable member thereby generating a softer collision noise due to the reduced collision impact.

According to the fifth aspect of the current invention, a method of substantially reducing a noise generated by a movable member upon contacting an inner wall of a groove located on a Geneva wheel, includes the following steps: a) biasing the movable member at a predetermined force towards the Geneva wheel; b) rotating the Geneva wheel until the groove approaches the movable member; c) blocking the force to reach the movable member when the movable member reaches a predetermined position with respect to the groove; and d) engaging the movable member without making the inner wall of the groove colliding onto the movable member thereby generating a softer noise.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figures 4A, 4B, 4C, 4D, 4E:
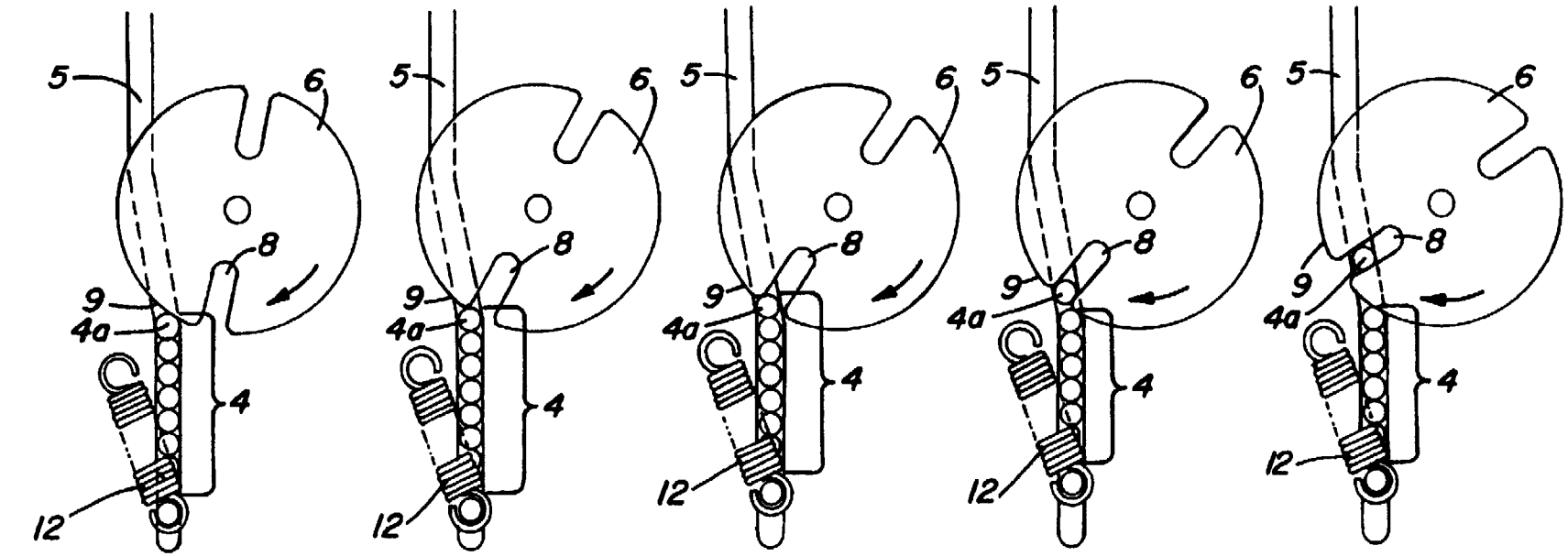
FIG. 4A PRIOR ART
FIG. 4B PRIOR ART
FIG. 4C PRIOR ART
FIG. 4D PRIOR ART
FIG. 4E PRIOR ART
FIGS. 4A–E illustrate sequential side views of how a conventional Geneva wheel engages one of upwardly biased movable pins and carries it to an upper part of the path guide.

Referring now to the drawings, wherein like reference numerals designate corresponding structure throughout the views, and referring in particular to FIGS. 4A through 4E, these sequential side views illustrate how movable pins 4 interact with a conventional Geneva wheel 6 and in particular how an undesirable collision noise is generated. FIG. 4A shows that a path guide 5 guides the pins 4 towards the conventional Geneva wheel 6 and the top pin 4*a* is urged against an outer surface 9 of the conventional Geneva wheel 6 by a biasing spring 12. As the conventional Geneva wheel 6 rotates in a clockwise direction as shown by an arrow in FIG. 4B, the top pin 4*a* continuously follows the outer contour 9 of the Geneva wheel 6. FIG. 4C illustrates a moment when the top pin 4*a* fails to follow the outer surface 9 of the Geneva wheel 6 and collides onto an inner wall 10 of the groove 8. This critical moment for the undesirable collision noise will be later explained in detail in reference to FIG. 5. As the Geneva wheel 6 continues to rotate, FIG. 4D illustrates that the top pin 4*a* enters into the groove 8. FIG. 4E illustrates that the top pin 4*a* remains in the groove 8 while it is carried in an upward direction along the path guide 5.

Figure 1:
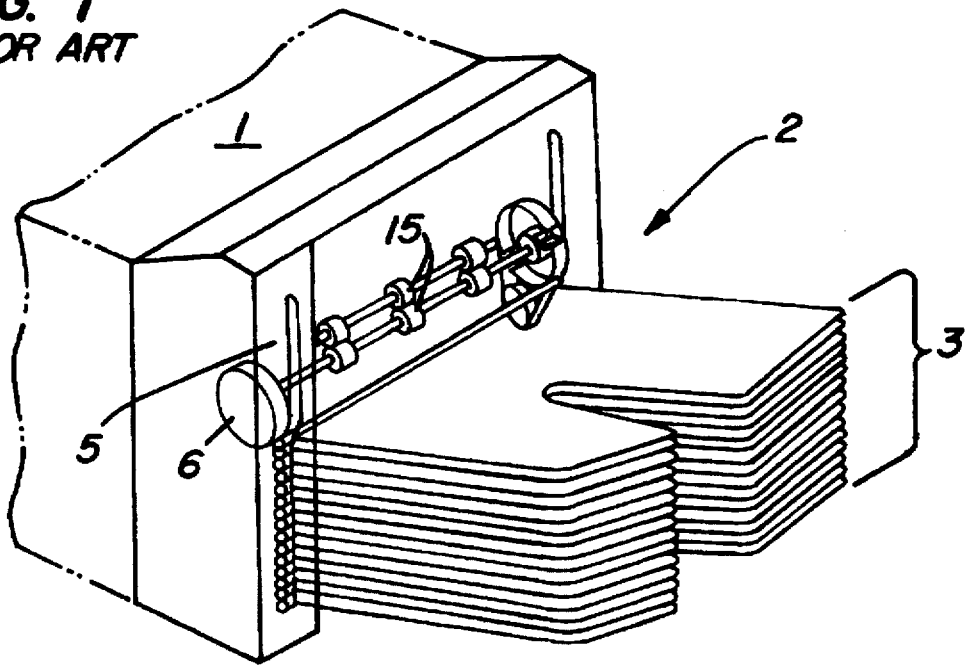
FIG. 1 PRIOR ART
FIG. 1 is a perspective view of a conventional sorter attached to an image reproduction machine.
Figure 2:
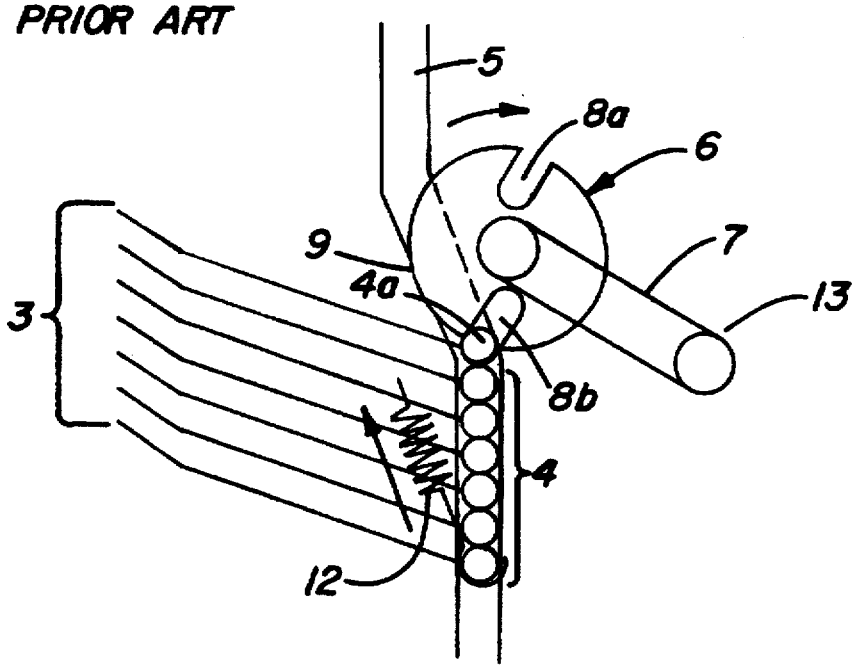
FIG. 2 PRIOR ART
FIG. 2 shows a diagrammatic side view of certain elements of the conventional sorter illustrated in FIG. 1 as the trays are to be moved in an upward direction.
Figure 3:
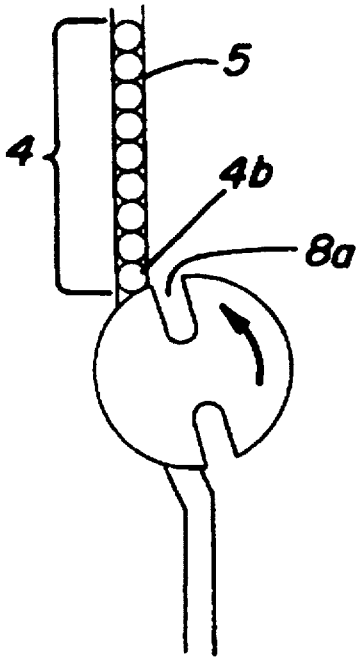
FIG. 3 PRIOR ART
FIG. 3 shows a diagrammatic side view of certain elements of the conventional sorter illustrated in FIG. 1 as the trays are to be moved in a downward direction.
Figure 5:
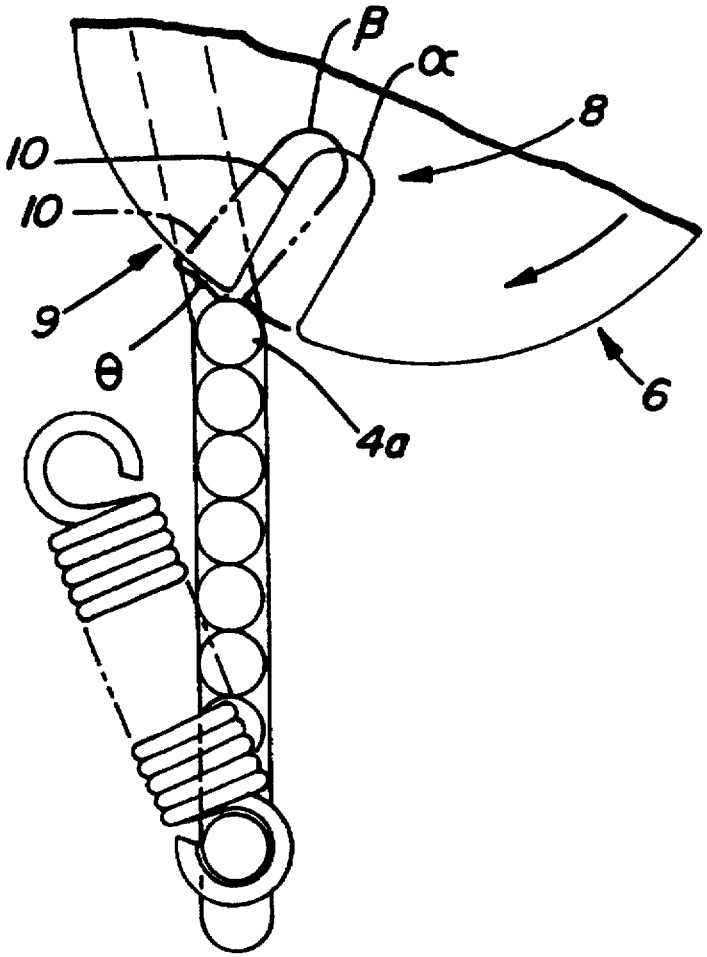
FIG. 5 PRIOR ART
FIG. 5 illustrates a magnified view of a critical point existing between FIG. 4B and 4C when the movable pin fails to follow the contour of the outer surface of the Geneva wheel and is about to collide onto an inner wall of the Geneva wheel.

Now referring to FIG. 5, as the top pin 4*a* is about to enter into the groove 8 of the conventional Geneva wheel 6, the top pin 4*a* collides onto an inner wall of the groove 8. This collision occurs when the top pin 4*a* experiences a sudden change in the contour of the outer surface 9 as the conventional Geneva wheel 6 rotates from the position $\alpha$ to the position $\beta$. At the position $\alpha$, a point adjacent to the intersection between the inner wall 10 and the outer surface 9 is in contact with the top pin 4*a*. However, as the conventional Geneva wheel 6 further rotates in a clockwise direction as indicated by an arrow, the groove 8 reaches the position $\beta$ as indicated in an dotted line. Due to the acute angle change in the contour 9 of the conventional Geneva wheel 6, the pin 4 faces a sudden gap $\theta$ between itself and the inner wall 10. Since the pin 4 is still subject to the upward bias force exerted by the bias spring 12, the pin 4 collides onto the inner wall 10 of the groove 8 and generates an undesirably loud noise.

Figure 6:
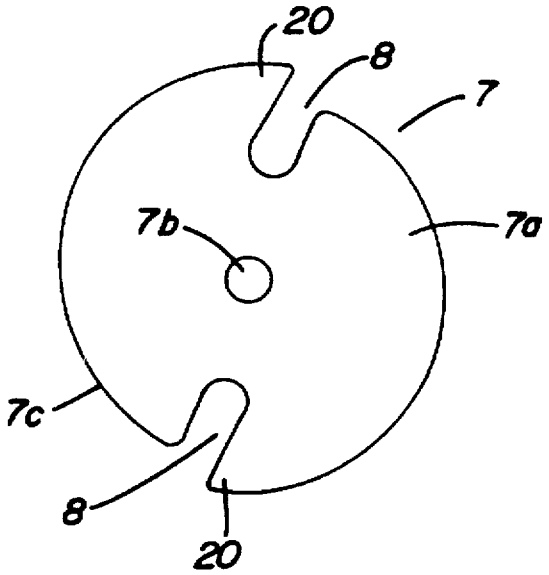
FIG. 6 illustrates one preferred embodiment of an improved Geneva wheel according to the current invention.

In order to substantially reduce the above described collision noise, referring to FIG. 6, one preferred embodiment of a collision protector according to the current invention is an improved Geneva wheel 7. The improved Geneva wheel 7 includes a disk-like body 7*a*, a center of rotation 7*b*, a pair of grooves 8 and a pair of the collision protector 20. In this preferred embodiment, the grooves 8 are slightly off a line intersecting the center of rotation 7*b* but are in parallel to the intersecting line. However, the grooves 8 may be located along the intersecting line. Each groove 8 has an opening along the outer surface 7*c* to accept a pin. One side of the opening integrally forms a collision protector 20. In general, this projected portion 20 of the improved Geneva wheel 7 is inserted between the top pin 4*a* and the adjacent pin 4 as the top pin 4 is about to engage in the groove 8. Since the inserted collision protector 20 blocks the bias to the top pin 4*a*, the top pin 4*a* is substantially prevented from colliding onto the inner wall as will be described below.

Figures 7A, 7B, 7C, 7D, 7E:
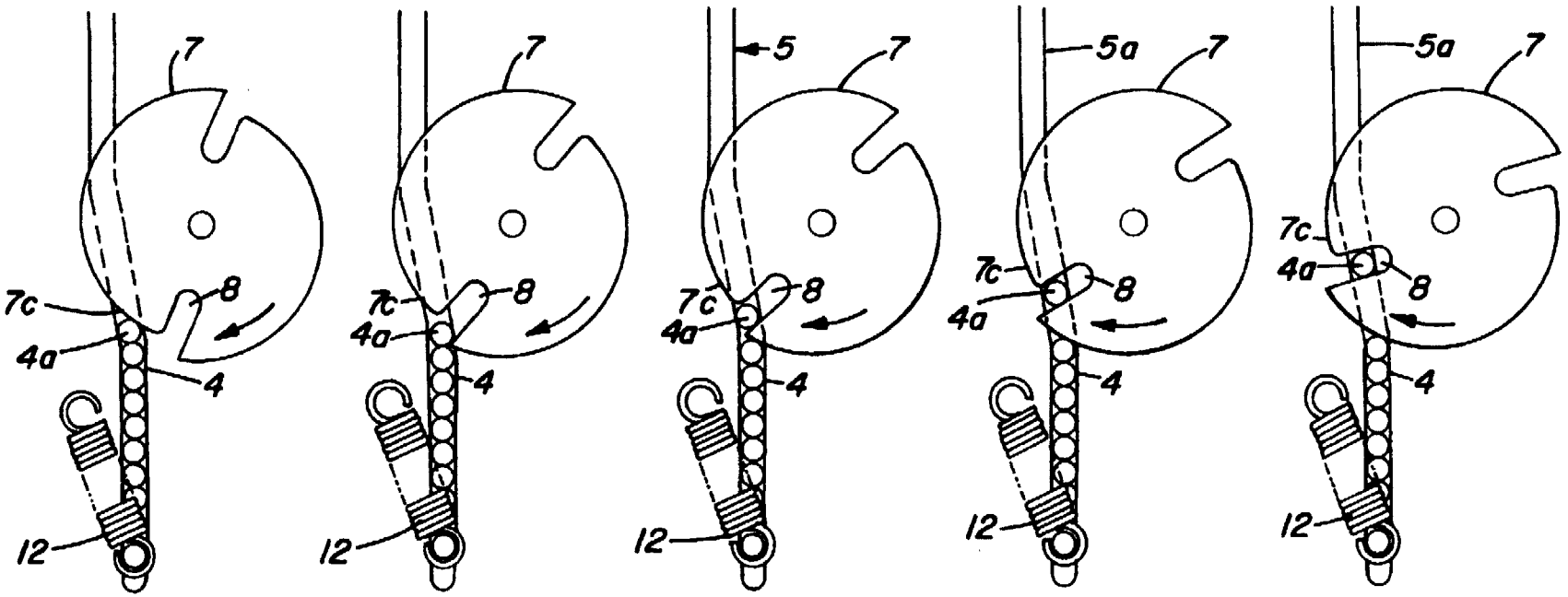
FIG. 7A–E illustrate sequential side views of how an improve Geneva wheel engages one of upwardly biased movable pins and how the improved Geneva wheel substantially prevents a collision between the pin and the inner wall.

Sequential side views of FIGS. 7A through 7E depict how the above described preferred embodiment of the collision protector 20 substantially prevents the collision and consequently substantially reduces the undesirable noise. FIG. 7A illustrates that the top pin 4*a* approaches the groove 8 as the improved Geneva wheel 7 rotates in a clockwise direction as indicated by an arrow. During the rotation, the top pin 4*a* is urged against the outer surface 7*c* of the improved Geneva wheel 7 and maintains the contact.

FIGS. 7B and 7C illustrate that as the improved Geneva wheel 7 further rotates, the projected collision protector 20 is being inserted between the top pin 4*a* and the adjacent pin 4. More particularly, when the top pin 4*a* is about to enter into the groove 8, the collision protector 20 isolates the top pin 4*a* from the upward bias force exerted by the bias spring 12 by the above described insertion. In other words, the isolated top pin 4*a* is free from the bias force when the top pin 4*a* faces the above described sudden gap. Due to the lack of the bias force to the top pin 4*a*, the improved Geneva wheel 7 smoothly engages the top pin 4*a* in the groove 8 without a harsh collision. After the top pin 4*a* enters in the groove as shown in FIGS. 7D and 7E, the top pin 4 remains there while it is being carried towards an upper portion 5*a* of the path guide 5.

To evaluate the effect of the above described improved Geneva wheel 7 on the collision noise level during the sorter operation, the noise generated using the improved Geneva wheel 7 including the collision protector 20 is measured in dB for comparison with that using a conventional Geneva wheel 6 under the same conditions. In general, approximately 5% noise reduction was realized due to the preferred embodiment of the collision protector 20.

Figure 8A:
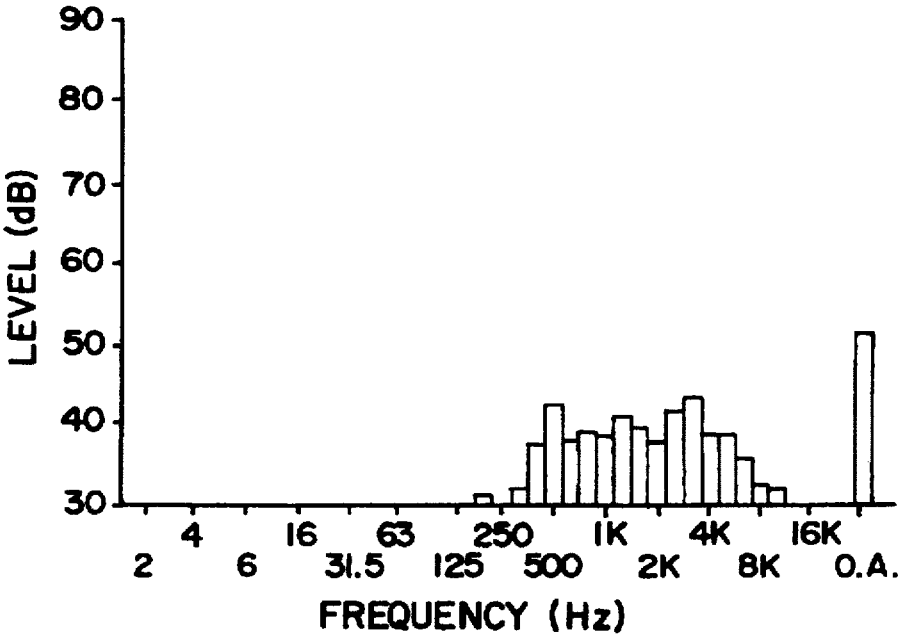
FIGS. 8A and 8B respectively show the frequency distribution of an average noise generated by a sorter with an improved Geneva wheel of the current invention and that with a conventional Geneva wheel.
Figure 8B:
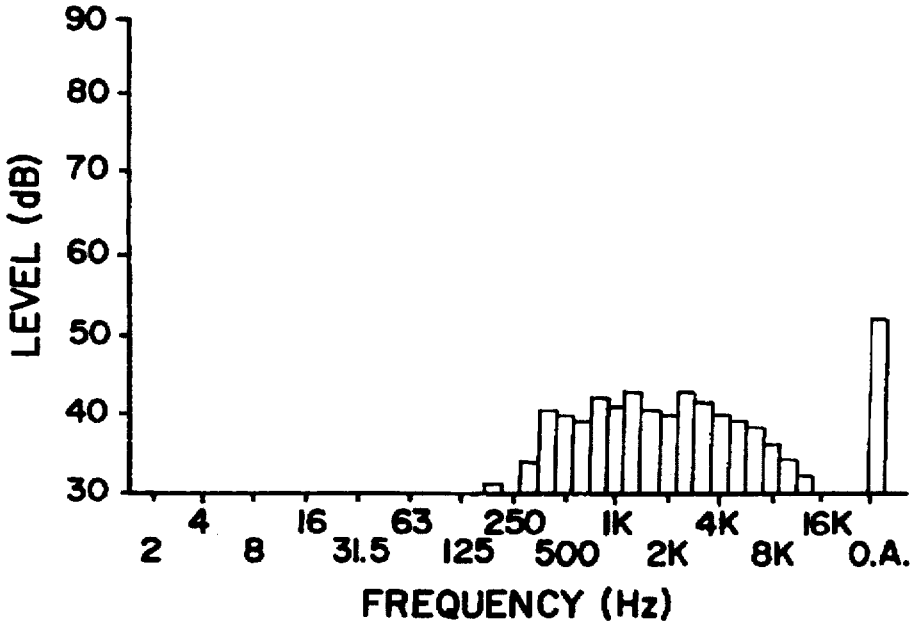
FIG. 8B PRIOR ART

Referring to FIGS. 8A and 8B, the noise level of a sorter is measured over 32 seconds at a location 1.0 m away from the sorter and 1.0 m from the ground during the sorter operation, and an average noise level in dB is shown for each of the frequencies. FIG. 8A shows the average noise frequency spectrum with an improved Geneva wheel according to the current invention. FIG. 8B shows the above described average noise frequency spectrum with a conventional Geneva wheel. The frequency distributions are generally similar. However, as shown in FIG. 8A, except for the four frequency levels, a sorter with the improved Geneva wheel of the current invention generates approximately less than 40 dB noise. In contrast, FIG. 8B shows that the sorter with the conventional Geneva wheel generates approximately 40 or more dB at many frequency levels. The average noise level with the conventional Geneva wheel 6 is approximately 52.5 dB while that with the improved Geneva wheel 7 including the collision protector 20 is approximately 50.7 dB.

Figure 9A:
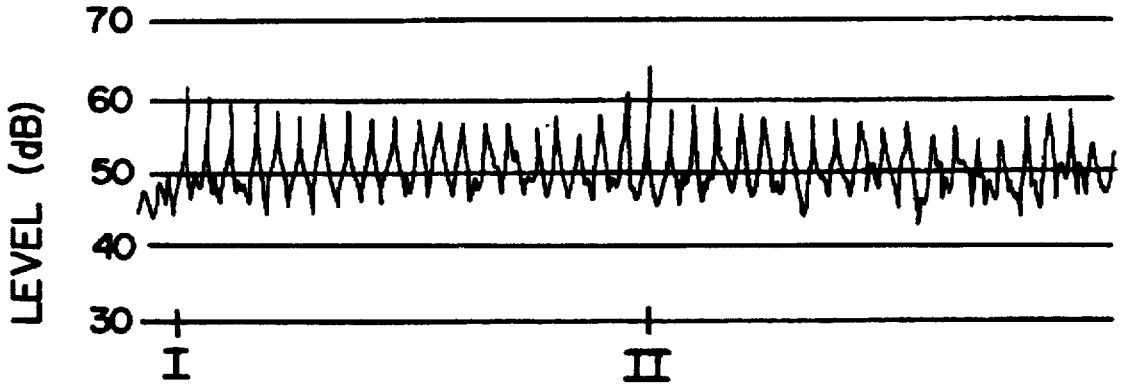
FIGS. 9A and 9B respectively show the noise level generated by a sorter with an improved Geneva wheel of the current invention and that with a conventional Geneva wheel.
Figure 9B:
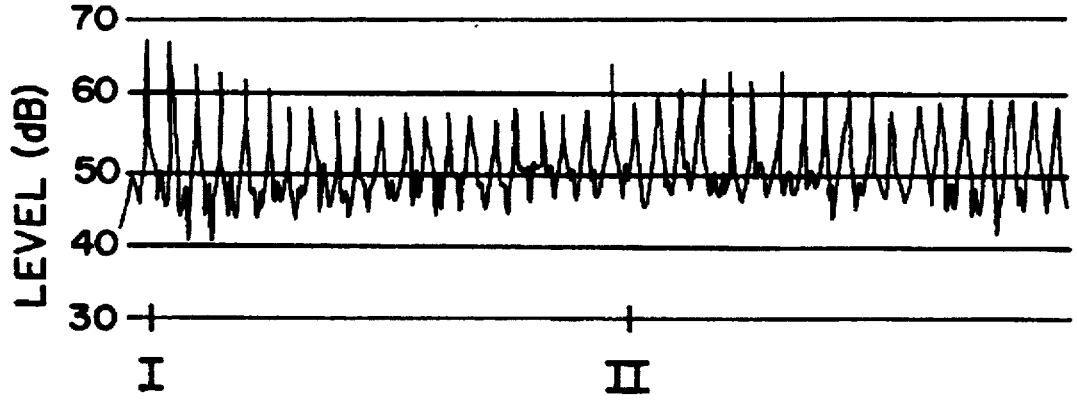
FIG. 9B PRIOR ART

Referring to FIG. 9A and 9B, the noise level of a sorter is measured for ⅛ second at a location 1.0 m away from the sorter and 1.0 m from the ground during the sorter operation, and a noise level in dB is shown. FIG. 9A shows the noise generated by a sorter with the improved Geneva wheel according to the current invention while FIG. 9B shows that with a conventional Geneva wheel. In both graphs, a point I indicates the start of an upward movement of a pin and a point II indicates the start of a downward movement of the pin. During the upward movement at Point I, the collision noise with the conventional Geneva wheel 6 is approximately 67.5 dB while that with the improved Geneva wheel 7 including the collision protector 20 is approximately 64.5 dB. During the downward movement at Point II, the noise level does not change significantly, but following Point II, the noise level stays higher with the conventional cam than that with the improved cam. A reason for this prolonged high noise level during the downward movement will be later described.

Figure 10:
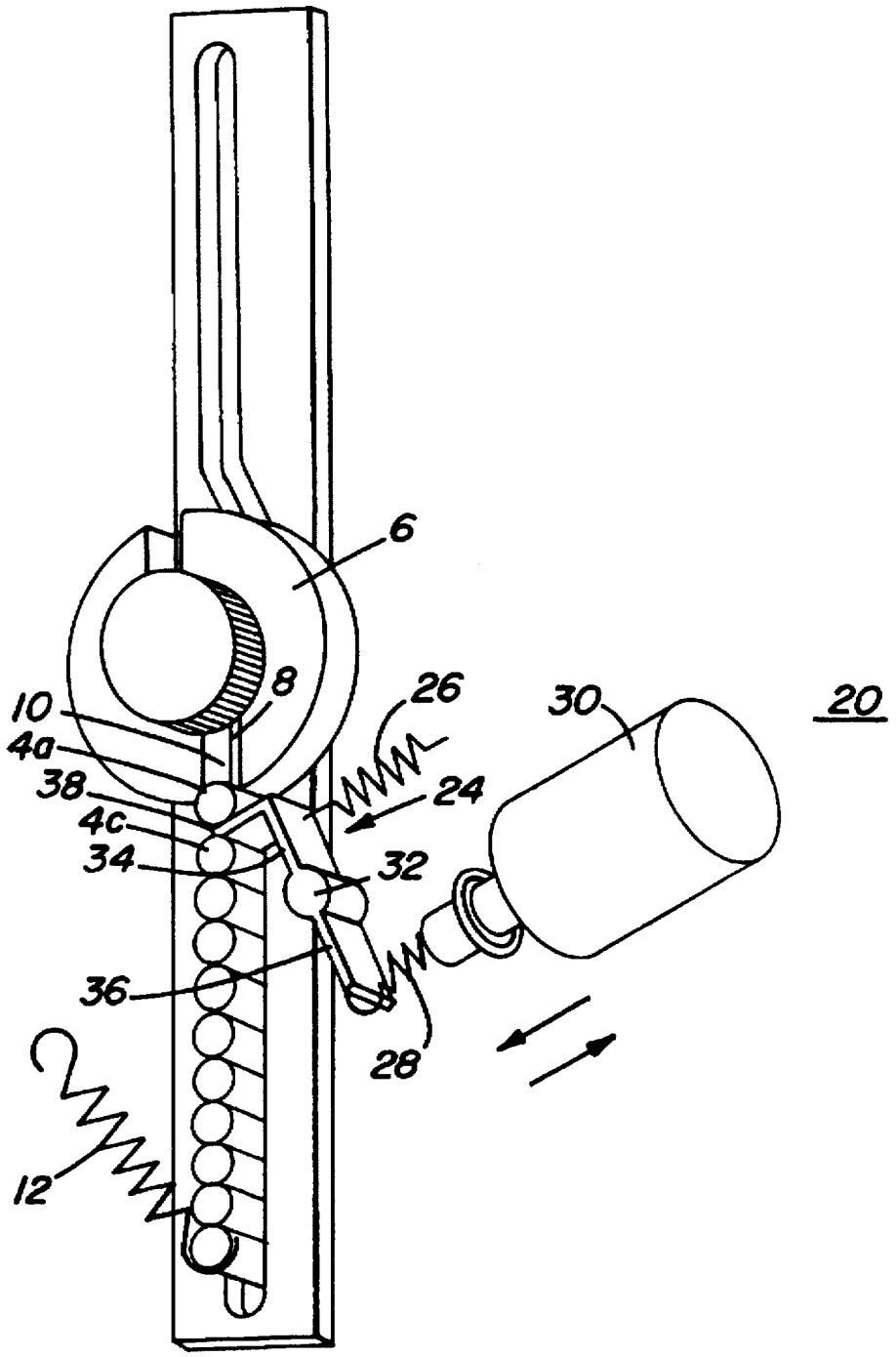
FIG. 10 illustrates a second preferred embodiment for collision reduction means which substantially reduces the collision between an upwardly biased pin and the Geneva wheel.
Figure 12:
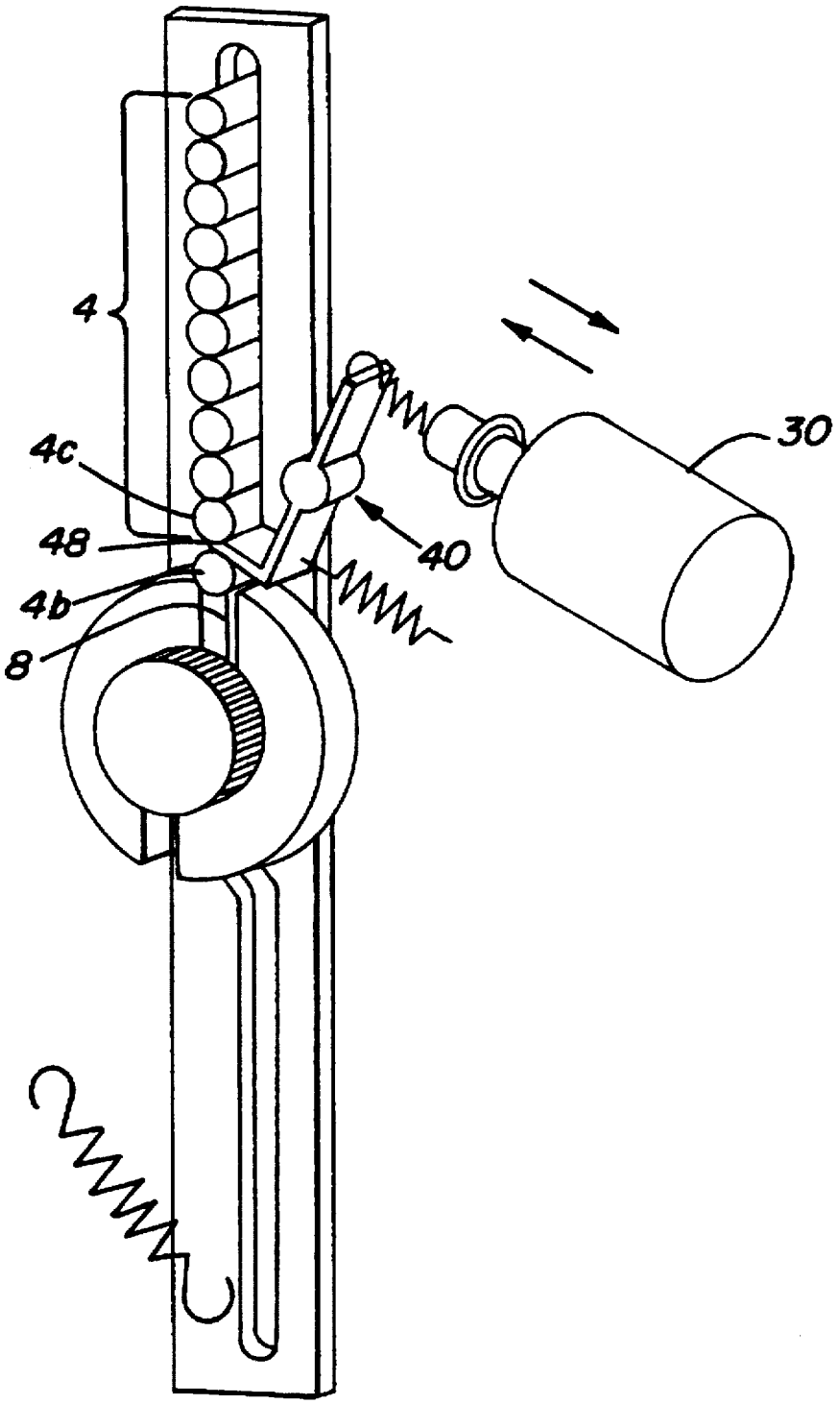
FIG. 12 illustrates a third preferred embodiment for collision reduction means which substantially reduces the collision between a downwardly directed pin and the Geneva wheel.

Referring to FIG. 10, the second preferred embodiment of the collision protector 20 is illustrated. In this embodiment, the collision protector 20 includes an L-shaped member 24, a first spring 26, a second spring 28 and a solenoid 30. The L-shaped member 24 is located near the top pin 4*a* and movably supported by a point 32. Both a upper portion 34 and a lower portion 36 are respectively urged by a first spring 26 and a second spring 28 in an opposing direction.

However, the other end of the second spring 28 is connected to the solenoid 30. The upper portion 34 further includes an insertion portion 38 which is movably inserted between the top pin 4a and an adjacent pin 4c. When the insertion portion 38 is inserted as shown in FIG. 10, an upward bias force exerted by a bias spring 12 is blocked and the top pin 4a is free from the bias force. The above described insertion movement is accomplished by activating the solenoid 30. Because of the controlled movement of the insertion portion 38, as the Geneva wheel 6 rotates, the unbiased top pin 4a is accepted into the groove 8 without colliding into an inner wall 10. Consequently, the second embodiment of the current invention substantially eliminates the undesirable collision and substantially reduces the associated collision noise.

Figure 11A:
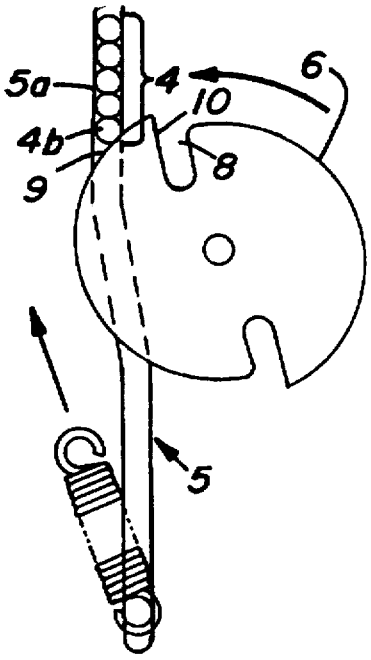
FIGS. 11A–11C illustrate sequential views of how an improved Geneva wheel engages a bottom most movable pin and how the Geneva wheel substantially prevents a collision between the pin and the inner wall.
Figure 11B:
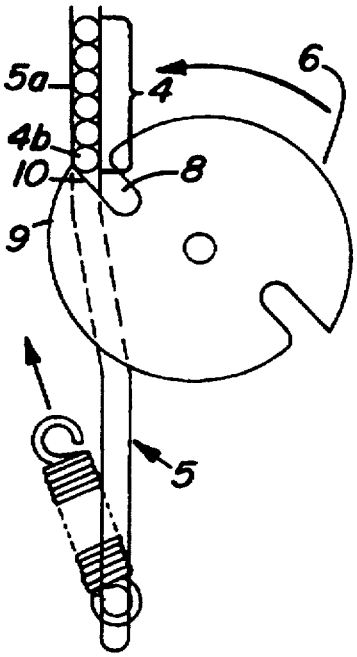
Figure 11C:
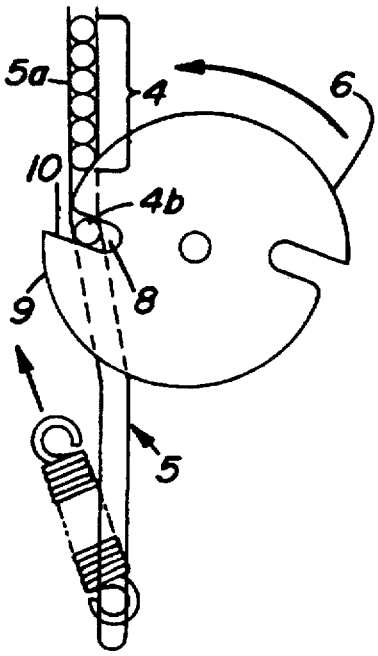

Now referring to FIGS. 11A through 11C, when the pins 4 are all carried to an upper part 5a of a path guide 5 in the above described manner, the pins 4 are now to be transferred back in a downward direction. In order to accomplish the downward transfer of the trays 3, the Geneva wheel 6 rotates in a counter clockwise direction to engage the pins 4. FIG. 11A illustrates one of sequential views in which the groove 8 approaches the bottom pin 4b. Although there is no bias force on these vertically stacked pins 4, the weight of each pin exerts gravitational force on the pins below. Due to the gravitational force, the bottom pin 4b is pressed against the outer surface 9 of the conventional Geneva wheel 6 to follow the contour.

As shown in FIG. 11B, when the conventional Geneva wheel further rotates in a counter clockwise direction to engage the bottom pin 4b, a sudden change in the outer contour provides a gap between the bottom pin 4b and the groove 8. Thus, the bottom pin 4b is not in contact with the Geneva wheel 6 and collides onto an inner wall 10 of the groove 8 due to the gravitational force. As a result, an undesirable collision noise is generated.

The noise problem is worsened since the bottom pin 4b upon colliding the inner wall 10 rebounds. Since other pins 4 are not urged by a bias spring, the rebound motion of the bottom pin 4b is conveyed to these free pins 4 and generates an additional noise. As there are more pins placed in the upper portion 5a of the path guide 5, the bottom pin 4b experiences more gravitational force. The larger gravitational force causes both a louder collision noise as well as a louder rebounding noise.

In order to substantially reduce the undesirable collision noise during the above described downward movements of the pins 4, according to one preferred embodiment of the downward collision protector of the current invention, a downward L-shaped collision protector 40 is placed near the bottom pin 4b. The downward L-shaped collision protector 40 has comparable parts as the upward L-shaped collision protector 24 and these parts have been already described with referenced to FIG. 10. The downward L-shaped collision protector 40 functions in a similar fashion as one shown for the upwardly moving pins 4 as shown in FIG. 10. However, the downward L-shaped collision protector 40 is placed upside down with respect to the upward L-shaped collision protector 24. The insertion portion 48 is inserted between the bottom pin 4b and the adjacent pin 4c at a certain time with respect to the Geneva wheel rotation. Since the insertion portion 48 holds the pins 4 from moving downwardly, the bottom pin 4b is substantially free from the gravitational force exerted by other pins 4 as it engages the groove 8. As a result, the downward L-shaped collision protector 40 substantially reduces a collision noise during the engagement of the bottom pin 4b in the groove 8.

In addition to making the bottom pin 4b substantially free from the above described gravitational force, the insertion portion 48 prevents the bottom pin 4b from rebounding in an upward direction after an initial contact with the Geneva wheel. In other words, the downward L-shaped collision protector 40 also functions as a rebound damper or a rebound reduction means. This second function is particularly critical in reducing the undesirable noise during the downward movement of the pins 4 since at the initial state of the downward travel, under certain circumstances, the undesirable noise level from above described rebounding is louder than collision. The above described L-shaped member as a collision protector as well as a rebound blocker substantially reduces the undesirable noise during the downward movement of the pins 4.

Figures 13A, 13B, 13C:
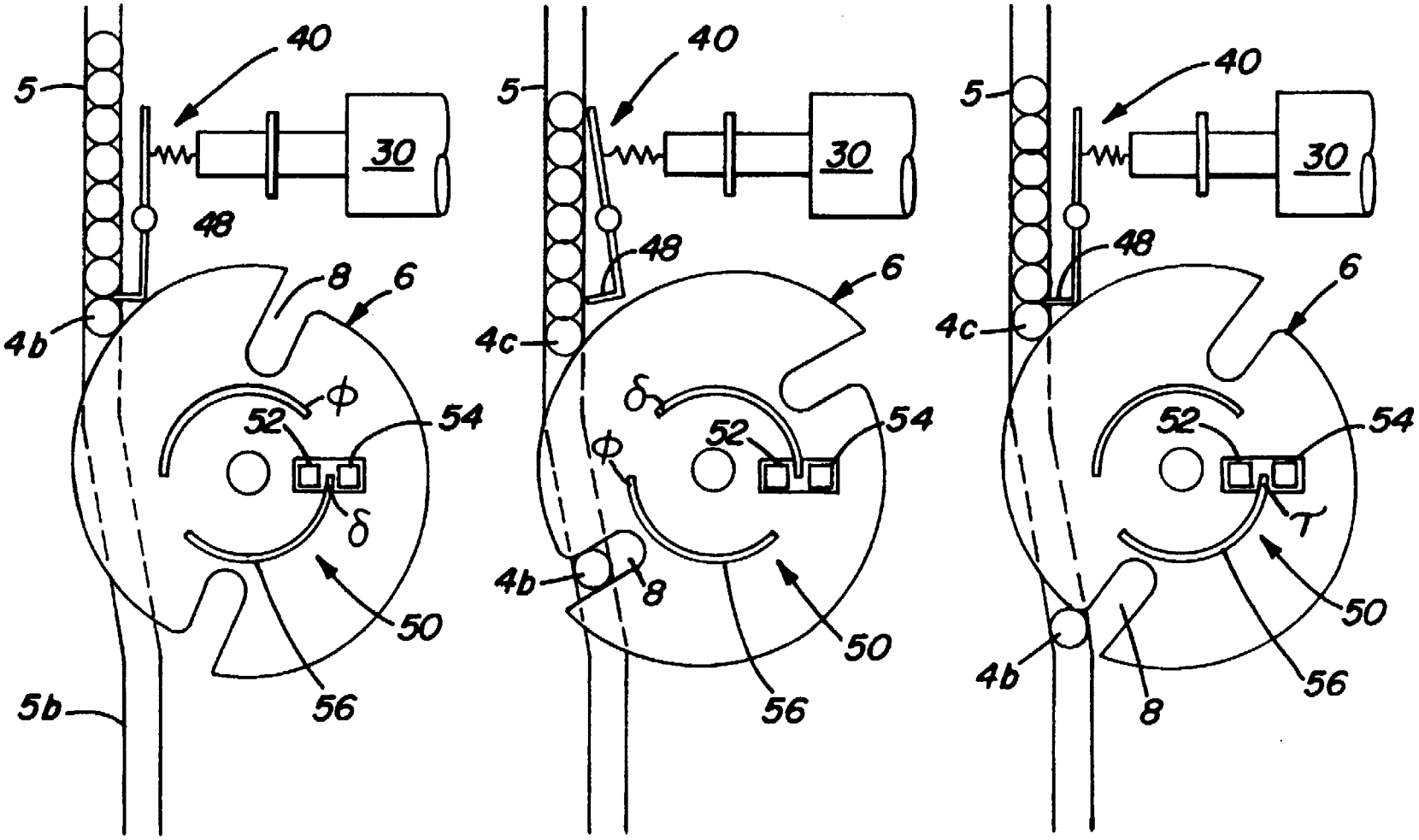
FIG. 13 illustrates sequential views depicting a collision protector means for detecting a predetermined angular position of the Geneva wheel and generating an output signal indicating the angular position so as to control the movement of a collision protector.

In order to coordinate the movement of the downward L-shaped collision protector 40 with respect to the Geneva wheel rotation, a angular position sensor 50 is used as shown in FIGS. 13A through 13C. The angular position sensor 50 includes a light emitting source 52, a photo sensitive detector 54 and a position ring 56. The position ring 56 is fixedly disposed on a side of the Geneva wheel 6 and has at least one opening 58. The photo sensitive detector 54 and the light emitting source 52 are opposingly positioned across the position ring 56. As the Geneva wheel 6 rotates to a first predetermined angle $\delta$ as shown in FIG. 13A, since light emitted from the light emitting source 52 is blocked by the position ring 56, the photo sensitive detector 54 turns from low to high or from off to on. At this predetermined angular position $\delta$, the solenoid 30 is activated and the insertion portion 48 of the downward L-shaped collision protector 40 is inserted between the bottom pin 4b and the adjacent pin 4c so as to substantially reduce the collision noise when the Geneva wheel 6 rotates further to accept the bottom pin 4b in the groove 8. After the Geneva wheel 6 accepts the bottom pin 4b in the groove 8 and when the Geneva wheel 6 further rotates beyond a second predetermined position $\phi$, the photo sensitive detector 54 now turns from on to off or from high to low. As shown in FIG. 13B, at this point beyond the predetermined angle $\phi$, in response to the photo detector 54, the solenoid 30 is deactivated to pull the insertion portion 48 away from the pins 4 to allow the pins 4 to move downwardly towards the Geneva wheel 6. Lastly, when the Geneva wheel 6 further rotates to carry the bottom pin 4b to the lower portion 5b of the path guide 5 as shown in FIG. 13C, the photo detector 54 turns again from off to on or from low to high at a predetermined angular position $\tau$. In response to the photo detector 54, the solenoid is again activated to insert the insertion portion 48 above the next bottom pin 4c and the Geneva wheel 6 stops for a predetermined period so that the tray at a predetermined receiving position receives a duplicated image output sheet.

Figure 14:
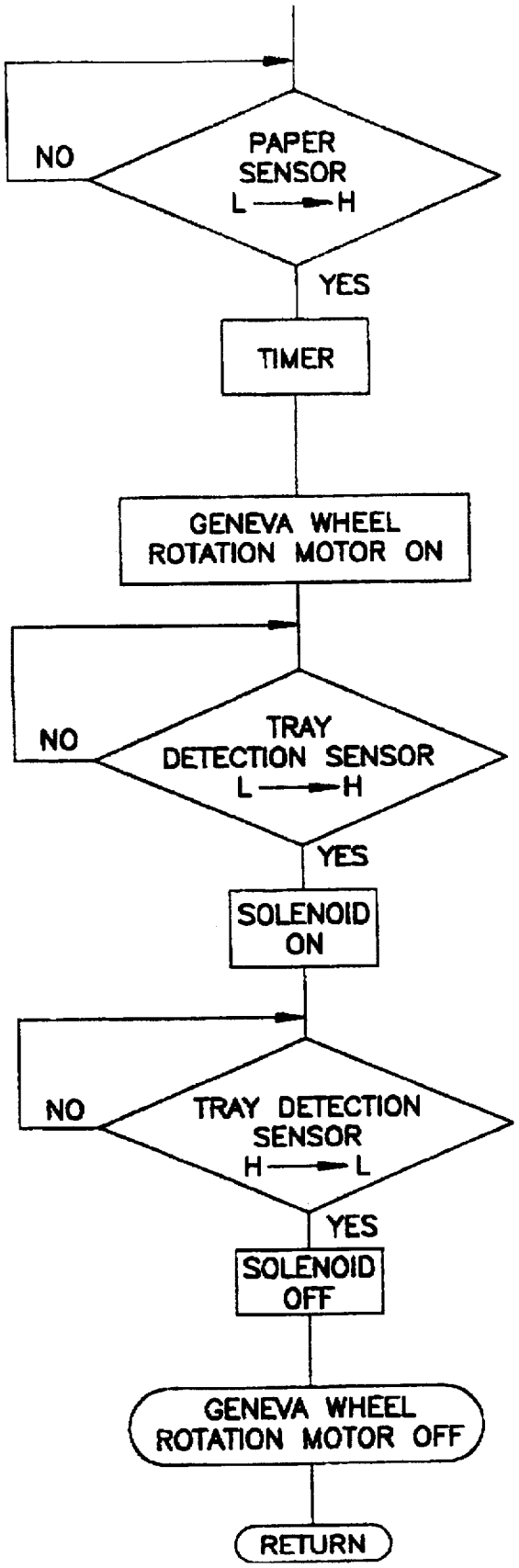
FIG. 14 is a flow chart depicting the control of a collision protector in relation to an output signal from the detector as shown in FIG. 13.

Referring to FIG. 14, the above described timing of the solenoid activations is summarized in a flow chart. When a paper output is detected, a timer for and the Geneva wheel rotation motor are activated. The timer keeps track of time for dispensing the paper output on a dispensing tray. As the Geneva wheel rotates and reaches a certain predetermined angle such as the above described predetermined angle $\delta$, when the angular position sensor turns low to high, the solenoid is activated and left on until the angular position sensor turns high to low at another predetermined angle such as $\phi$. At this time, the solenoid is deactivated and the Geneva wheel rotation motor stops. The above described process is repeated as necessary.

Figure 15:
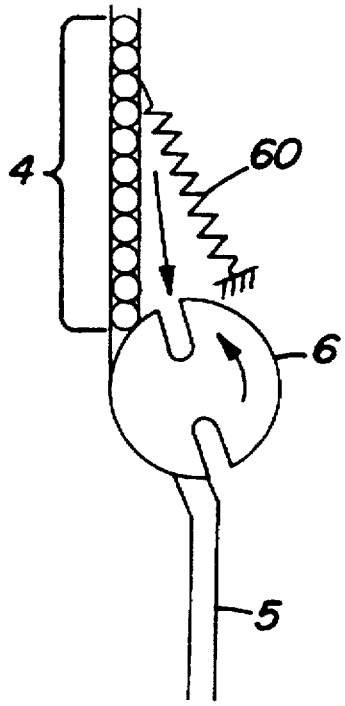
FIG. 15 illustrates one embodiment of rebound reduction means including downward bias springs to substantially reduce the rebound movement of the pins as they are transferred towards a bottom portion of the path guide.

Referring to FIG. 15, a second embodiment for the rebound reduction means includes a dumper spring 60 that provides a bias to the pins in a substantially downward direction. This downward bias prevents the bottom pin 4b from rebounding when it makes a contact with the Geneva wheel 6. The damper spring 60 exerts the downward bias when the height of the vertically stacked pins 4 exceeds at least a lower end of the top damper spring 60. The damper spring 60 may be placed at a closer position towards the Geneva wheel 6 along the path guide 5 when a small number of pins 4 is used. Although the rebound damper spring 60 reduces the undesirable noise by substantially eliminating the rebound movements, since it may increase the collision noise between the bottom pin 4b and the Geneva wheel 6, an appropriate collision protector should be used in combination.

Figure 16:
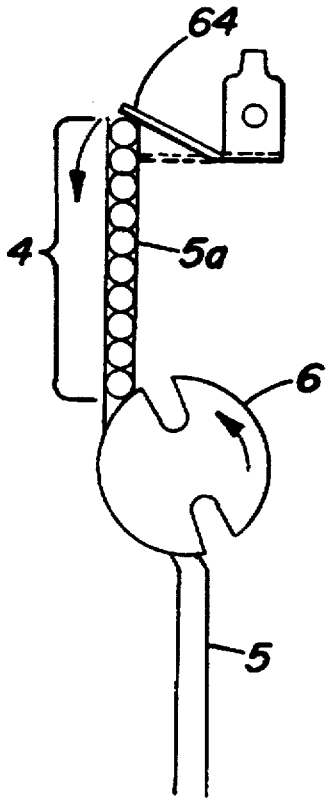
FIG. 16 illustrates another embodiment of the rebound reduction means including a spring board.

Now referring to FIG. 16, the third embodiment of the rebound reduction means includes a spring board 64. The spring board 64 is fixedly placed at the top of the stacked pins 4 and selectively exerts a downward bias on the stacked pins 4 only when the height of the stacked pins 4 exceeds the spring board position. Since the undesirable rebound noise is generated when a large number of the pins 4 is in the top portion 5a of the path guide 5, the selective downward bias is advantageous.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved cam for substantially reducing noise generated by imparting motion to a movable member, comprising:

a body having a center of rotation and an outer surface located along an edge of said body for guiding the movable member along a contour of said outer surface;

a groove located on said body and having an inner walls, said inner walls intersecting said outer surface for engaging the movable member, said inner walls comprising parallel sides of said groove, a center line located equidistant and parallel to said sides, said center line disposed to be nonintersecting with said center of rotation of said body; and a collision protector located near said groove for preventing the movable member from colliding onto one of said inner walls upon engaging said groove thereby reducing a noise generated by a collision between said one of said inner walls and the movable member.

2. The improved cam according to claim 1 wherein said collision protector is a wedge integrally projected from said outer surface near said groove, said wedge engaging the movable member as the movable member approaches said groove so as to substantially eliminate a momentum of the movable member.

3. The improved cam according to claim 1 wherein said body has a center of rotation, said outer surface is curved with a varying radius with respect to said center of rotation.

4. An improved Geneva wheel for substantially reducing noise generated by imparting motion to a movable member, comprising:

a disk-like body having a center of rotation and an outer surface along an edge of said disk-like body for guiding the movable member along said outer surface as said disk-like body rotates about said center of rotation;

a groove located on said body and having an inner walls, said inner walls intersecting said outer surface for engaging the movable member, said inner walls comprising parallel sides of said groove, a center line located equidistant and parallel to said sides, said center line disposed to be nonintersecting with said center of rotation of said disk-like body; and a collision protector located near said groove for preventing the movable member from colliding onto one of said inner walls upon engaging said groove thereby reducing a noise generated by a collision between said one of said inner walls and the movable member.

5. The improved Geneva wheel according to claim 4 wherein said collision protector is a wedge integrally projected from said outer surface near said groove, said wedge engaging the movable member as the movable member approaches said groove.

6. The improved Geneva wheel according to claim 4 wherein said outer surface is curved with a varying radius with respect to said center of rotation.

7. The improved Geneva wheel according to claim 4 wherein said groove consists of at least an opposing pair of elongated gaps.

8. An improved sorter for substantially reducing a noise, comprising:

a plurality of movable members each having a sorter tray;

a guide path for guiding said plurality of said movable members along a predetermined path;

a biasing means for exerting a biasing force on said plurality of said movable members in a predetermined direction along said guide path;

a Geneva wheel located near said guide path and having a center of rotation and at least one groove for engaging one of said plurality of said movable members so as to advance said movable members at a predetermined interval along said guide path, said groove having inner walls, said inner walls comprising parallel sides of said groove, a center line located equidistant and parallel to said sides, said center line disposed to be nonintersecting with said center of rotation of said Geneva wheel; and a collision protector located near said groove for preventing the movable member from colliding onto one of said inner walls upon engaging said groove thereby reducing a noise generated by a collision between said one of said inner walls and said movable member.

9. The improved sorter system according to claim 8 wherein said collision protector is an independent L-shaped member having an insertion portion, said insertion portion engaging one of said movable members as said one of said movable members approaches said groove so as to avoid said one of said movable members from colliding onto one of said inner walls.

10. The improved sorter system according to claim 9 further comprising a controller for controlling said independent L-shaped member, said insertion portion being inserted between said one of said movable members and others of said movable members so as to isolate said one of said movable members from said others of said movable members.

11. The improved sorter system according to claim 8 wherein said collision protector is a wedge portion integrally projected from said outer surface near said groove, said wedge portion engaging said one of said movable members as said one of said movable members approaches said groove so as to isolate said one of said movable members from others of said movable members.

12. The improved sorter system according to claim 8 wherein said movable members are pins each having a shaft and two ends, each of said ends being guided by said guide path, said shaft being connected to said sorter tray.

13. The improved sorter system according to claim 12 wherein said guide path is a vertical path, said biasing means providing an upward biasing force, said movable members traveling upwardly, said collision protector preventing said biasing means from exerting said upward biasing force upon one of said movable members as said one of said movable members approaches said groove.

14. The improved sorter system according to claim 13 wherein said guide path is a continuous vertical path.

15. The improved sorter system according to claim 12 wherein said guide path is a vertical path along which said movable members travel downwardly due to a gravitational force, said movable members being free from said biasing force, said collision protector substantially preventing said gravitational force from exerting on one of said movable members so as to substantially reduce a collision impact between said one of said movable members and said one of said inner wall.

16. The improved sorter system according to claim 15 wherein said collision protector prevents said movable members from moving upward due to a rebounding force after said collision impact.

17. A method of substantially reducing noise generated by a movable member upon contacting inner walls of groove located on a Geneva wheel, said Geneva wheel having a center of rotation, comprising the following steps of:

a) positions said inner walls parallel with each other, said inner walls defining a center line of said groove which is parallel to and equidistant from said inner walls;

b) positions said center line to be non-intersecting with said center of rotation of said Geneva wheel, said groove being defined as an off-centered groove; and c) exerting a force on the movable member in a predetermined direction towards the Geneva wheel;

d) rotating the Geneva wheel;

e) substantially preventing the exertion of said force on said movable member when said off-centered groove is juxtaposed thereto, thereby to reduce a collision impact on one of the inner walls of the off-centered groove by the movable member thereby generating a minimal collision noise.

18. The method of substantially reducing a noise as recited in claim 17 wherein said step e) further comprising a step of isolating the movable member in the vicinity of the groove from said force so that the movable member is physically blocked from receiving said force.

19. The method of substantially reducing a noise as recited in claim 18 wherein said force in said step c) is a biasing upward force.

20. The method of substantially reducing a noise as recited in claim 18 wherein said force in said step c) is a gravitational downward force.

21. The method of substantially reducing a noise as recited in claim 20 wherein said step of isolating the movable member substantially prevents the movable member from moving upwardly due to a rebounding movement resulted from said collision.

22. A method of substantially reducing a noise generated by a movable member upon contacting inner walls of a groove located on a Geneva wheel, said Geneva wheel having a center of rotation, said inner walls comprising parallel sides of said groove, a center line located equidistant and parallel to said sides, said center line disposed to be non-intersecting with said center of rotation of said Geneva wheel, said groove defined as an off-centered groove, and comprising the following steps of:

a) biasing the movable member at a predetermined force towards the Geneva wheel;

b) positioning the off-centered groove near the movable member;

c) blocking the force to reach the movable member when the movable member reaches a predetermined position with respect to the off-centered groove; and d) engaging the movable member without making the inner wall of the off-centered groove colliding onto the movable member thereby generating a softer noise.

23. An improved method of forming a Geneva Wheel system wherein said Geneva wheel is rotated about a center of rotation relative to a movable member so as to bring said movable member into juxtaposition with a groove in said Geneva wheel, said groove being formed by inner walls, the improvement comprising the steps of:

a) forming said inner walls in parallel with each other, said inner walls defining a center line of said groove, said center line located parallel to and equidistant from said inner walls;

b) positioning said center line to be non-intersecting with said center of rotation of said Geneva wheel, said groove thus being defined as an off-centered groove;

wherein a reduction of the noise level results from collision between said inner wall and said movable member by at least 5% over certain frequencies in a frequency range of 1 to 16 KHz.

24. The improved method as recited in claim 23 wherein the noise level is reduced by at least 10% over some of said certain frequencies in said frequency range.

* * * * *